US007600499B2

(12) United States Patent
Horimura et al.

(10) Patent No.: US 7,600,499 B2
(45) Date of Patent: Oct. 13, 2009

(54) TITANIUM ALLOY VALVE LIFTER

(75) Inventors: Hiroyuki Horimura, Wako (JP); Kosuke Doi, Wako (JP); Masaya Takata, Toyama (JP)

(73) Assignees: Honda Motor Co., Ltd., Tokyo (JP); Tanaka Seimitsu Kogyo Co., Ltd., Toyama (JP)

( * ) Notice: Subject to any disclaimer, the term of this patent is extended or adjusted under 35 U.S.C. 154(b) by 0 days.

(21) Appl. No.: 11/391,464

(22) Filed: Mar. 29, 2006

(65) Prior Publication Data

US 2006/0219200 A1 Oct. 5, 2006

(30) Foreign Application Priority Data

Mar. 30, 2005 (JP) ..... 2005-100016

(51) Int. Cl.
*F01L 1/14* (2006.01)

(52) U.S. Cl. ..... 123/90.51; 123/90.48

(58) Field of Classification Search ..... 123/90.51, 123/90.48, 90.27

See application file for complete search history.

(56) References Cited

U.S. PATENT DOCUMENTS 3,408,236 A * 10/1968 Van Hartesveldt ..... 148/336
5,304,263 A * 4/1994 Champin et al. ..... 148/671
6,210,807 B1 * 4/2001 Dong et al. ..... 428/472
6,237,441 B1 * 5/2001 Nishioka et al. ..... 74/569
6,607,693 B1 * 8/2003 Saito et al. ..... 420/417
2004/0084117 A1 * 5/2004 Woodfield et al. ..... 148/669

FOREIGN PATENT DOCUMENTS

JP 7-139314 A 5/1995

* cited by examiner

*Primary Examiner*—Zelalem Eshete
(74) *Attorney, Agent, or Firm*—Birch, Stewart, Kolasch & Birch, LLP

(57) ABSTRACT

A lightweight and high-strength valve lifter is excellent in wear resistance and sliding properties. The valve lifter is made of a titanium alloy having a hardened layer on the top surface thereof, on which a cam is caused to slide. The hardened layer is composed of an α-case and an oxygen diffusion layer under the α-case. The α-case 22 is formed in a thickness of not less than 3 μm and not more than 15 μm. The oxygen diffusion layer has a thickness of not less than 10 μm. The hardened layer on the top surface of the valve lifter is formed by oxidation treatment in a furnace at a temperature of not less than 600° C. An outermost oxide layer 21 formed on the α-case as a result of the oxidation treatment is removed.

20 Claims, 4 Drawing Sheets

AFTER OXIDATION TREATMENT

TITANIUM ALLOY VALVE LIFTER

BACKGROUND OF THE INVENTION

1. Field of the Invention

The present invention relates to a valve lifter made of titanium alloy and a method of manufacturing the same.

2. Description of the Related Art

A valve lifter in a valve operating mechanism of an internal combustion engine for racing is generally made of titanium. In car races there are few demands in terms of cost, and therefore the valve lifter is subjected to a surface treatment such as expensive ion plating in order to improve wear resistance. On the other hand, as for applying the titanium valve lifter to mass-produced vehicles, there are no practical cases of using a surface-treated titanium alloy especially due to the problem of costs because titanium itself is expensive and requires an expensive surface treatment. In addition, the valve lifter for mass-produced vehicles requires better properties in terms of the wear resistance than that for racing vehicles. A known example of the valve lifter made of titanium alloy is a valve lifter in which a surface part of the body thereof is hardened so as to form an oxygen diffusion layer. This valve lifter includes an adjusting shim in a sliding surface of the valve lifter body on which a cam slides. The sliding surface particularly requires wear resistance, and the adjusting shim is made of a material particularly excellent in sliding properties, for example, such as hard metal including carbon steel, stainless steel, and the like (refer, for example, to JP 7-139314 A, pages 2 to 3 and FIG. 1).

The above-mentioned document describes a valve lifter 01 made of a titanium alloy as shown in FIG. 6. This valve lifter has a structure in which a surface part of the body thereof is hardened so as to form an oxygen diffusion layer 02 and an adjusting shim 05 made of a hard metal such as a carbon steel or a stainless steel is provided in a sliding surface 04 as an upper surface part 03 of the body of the valve lifter 01. The sliding surface 04 requires increased wear resistance because of sliding contact with a valve operating cam and is made of a hard metal which is particularly excellent in wear resistance and sliding properties, for example, such as carbon steel or stainless steel.

This valve lifter made of a titanium alloy includes the adjusting shim made of a hard metal such as a carbon steel or a stainless steel, which is a material excellent in wear resistance and sliding properties, to form the sliding surface of the top surface part of the body on which the cam slides. Accordingly, this adjusting shim increases the weight of the top part of the valve lifter. The increase in weight of the top part of the valve lifter causes an increase in the inertia weight of the valve lifter, thus reducing the effect of the titanium valve lifter employed for weight reduction. Furthermore, each tappet clearance is adjusted by the heavy adjusting shim, and valves have considerable variation in inertia weight. This can increase operating noise of the valve operating mechanism.

To solve the aforementioned problem, an inner shim type valve lifter has been proposed in which the adjusting shim is disposed between an inner surface of the valve lifter and the top end of a valve stem, and the body of the valve lifter and the sliding surface are integrally formed. In the valve lifter according to this proposal, the oxygen diffusion layer needs to be thicker on the sliding surface of the valve lifter on which the cam slides, than in the other parts of the valve lifter. However, there is no literature that describes on a concrete specification thereof. Moreover, the oxide layer could be separated during the sliding. Consideration has therefore been made for processes to grind valve lifters one by one and to remove a part of the oxide layer as the outermost surface part by shot blasting, but greatly increased manufacturing costs have been a problem in particular.

Under the circumstances as described above, it is the main object of the present invention to provide a lightweight and high-strength valve lifter which is made of a titanium alloy and has an excellent wear resistance and sliding properties, particularly, good properties in sliding on the cam. The present invention also provides a method of manufacturing the same.

SUMMARY OF THE INVENTION

According to an aspect of the present invention, there is provided a valve lifter made of a titanium alloy having a sliding surface that makes sliding contact with a cam, the valve lifter having been subjected to an oxidation treatment and comprising: an α-case formed at least on the sliding surface and having a thickness of not less than 3 μm and not more than 15 μm; and an oxygen diffusion layer formed under the α-case and having a thickness of at least 10 μm.

When the thickness of the α-case is less than 3 μm, the sliding properties on the cam are inadequate. When the thickness of the α-case is more than 15 μm, the α-case is brittle, and pitting is more likely to occur. Further, if the oxygen diffusion layer with a thickness of at least 10 μm were not provided under the α-case, cracks would be more likely to occur in the α-case because the hardness of the α-case is too different from that of the texture thereunder. Cracks that are formed in the α-case increase the likelihood of causing wear and pitting. Moreover, fatigue failures start from such cracks, and the strength is reduced.

The thickness of the α-case on said sliding surface is preferably not less than 5 μm and not more than 10 μm.

By setting the thickness of the α-case not less than 5 μm and not more than 10 μm, the valve lifter provides adequate capabilities even under severe conditions which cannot occur in normal driving conditions.

In a preferred embodiment of the invention, the sliding surface is given a surface roughness equal to a maximum height roughness Rz (JIS B 0601:2001) of not exceeding 4.

When the surface roughness of the sliding surface is larger than the above value, pitting is more likely to occur. When the surface roughness is determined such that the maximum height roughness Rz does not exceed 4, it is possible to ensure enough pitting resistance even under severe lubrication conditions. In order to make the surface roughness such that the maximum height roughness Rz does not exceed 4, the oxide layer formed on the surface needs to be removed. When the oxide layer remains even partially, good surface roughness cannot be obtained, and the pitting resistance is insufficient in some cases under extreme conditions.

Preferably, the valve lifter is composed of a Ti—Fe—O type alloy containing 0.6 to 1.4 wt % of iron (Fe) and 0.24 to 0.44 wt % of oxygen (O) as main components.

This alloy is given an increased strength by containing pure titanium as a basic material and increased amounts of Fe and O added as impurities. Accordingly, the alloy is excellent in cold or warm plastic workability despite the high strength thereof, thus facilitating shaping the valve lifter by forging. Furthermore, this alloy does not include an element improving oxidation resistance such as aluminum (Al) in the composition. For this reason, the α-case can be formed in a thicker layer than the layers that can be formed in the case of conventional alloys such as Ti-6Al-4V, and therefore this alloy is preferred to ensure proper wear resistance of the sliding surface on which the cam slides. When the contents of Fe and O are less than 0.6 wt % and 0.24 wt %, respectively, the strength required for the valve lifter cannot be obtained. When the contents of Fe and O exceed 1.4 wt % and 0.44 wt %, respectively, deformation resistance is increased, and forgeability is significantly reduced, so that cracks are produced and the life of the mold is reduced significantly, thus impairing mass productivity.

According to another aspect of the present invention, there is provided a method of manufacturing a valve lifter made of titanium alloy, comprising the steps of: performing an oxidation treatment on a valve lifter material in a furnace at a temperature not less than 600° C. with resultant formation of an oxide layer on the valve lifter material; taking out the thus treated valve lifter material at a temperature not less than 400° C. from within said furnace and cooling the same in the atmospheric air; and subsequently removing the oxide layer formed at least on a sliding surface of the valve lifter material, for sliding contact with a cam.

In order to obtain a thick α-case, the oxidation treatment needs to be performed at high temperature for a long period of time. When the oxidation treatment is performed at a temperature below 600° C., necessary thickness of the α-case cannot be obtained, and a thick oxide layer is formed on the outermost surface of the member. This oxide layer is not preferred and needs to be removed because the oxide layer is partially separated to promote wearing of associated members such as the cam when the valve lifter is sliding during the operation of a valve operating mechanism. To remove this solid oxide layer, the step of taking out the treated valve lifter material from within the furnace at a temperature of not less than 400° C. and cooling the same in the atmospheric air is performed, which facilitates removal of the oxide layer in the subsequent step. The cooling of the treated valve lifter material outside the furnace in the air is performed because of an effect of rapid cooling that facilitates separation of the oxide layer due to a difference in thermal expansions. However, if the taking out from within the furnace is performed at a temperature of less than 400° C., this effect is insufficient. The process of removing the oxide layer can be properly selected.

The step of removing the oxide layer may be carried out by a vibration barrel machine.

Grinding energy of the vibration barrel machine is moderate, and grinding by the vibration barrel machine can remove the oxide layer without damaging the α-case and oxygen diffusion layer under the oxide layer. For example, the oxide layer could be removed by shot blasting or the like. However, the grinding energy is high in the case of the shot blasting. Consequently, when comparison is made between a part where the removal of the oxide layer has been completed and another part where the removal of the oxide layer has not yet fully completed, it is observed that the α-case is roughed in the part where the removal of the oxide layer has been completed, and good surface roughness cannot be obtained on the layer of the α-case. On the contrary, by grinding with the use of the vibration barrel machine, the operation of separating and removing the oxide layer on the surface of the valve lifter can be performed in a comparatively simplified removal step. Moreover, the vibration barrel machine can simultaneously grind a number of valve lifters together to remove the oxide layer, thus increasing an efficiency of the step to separate and remove the oxide layer on the surface of the valve lifter and reducing the cost for the operation. Moreover, grinding with the use of the vibration barrel machine allows removal of the oxide layer and simultaneously allows surface polishing, and it is therefore possible to provide good surface roughness.

DESCRIPTION OF THE PREFERRED EMBODIMENTS

Figure 1:
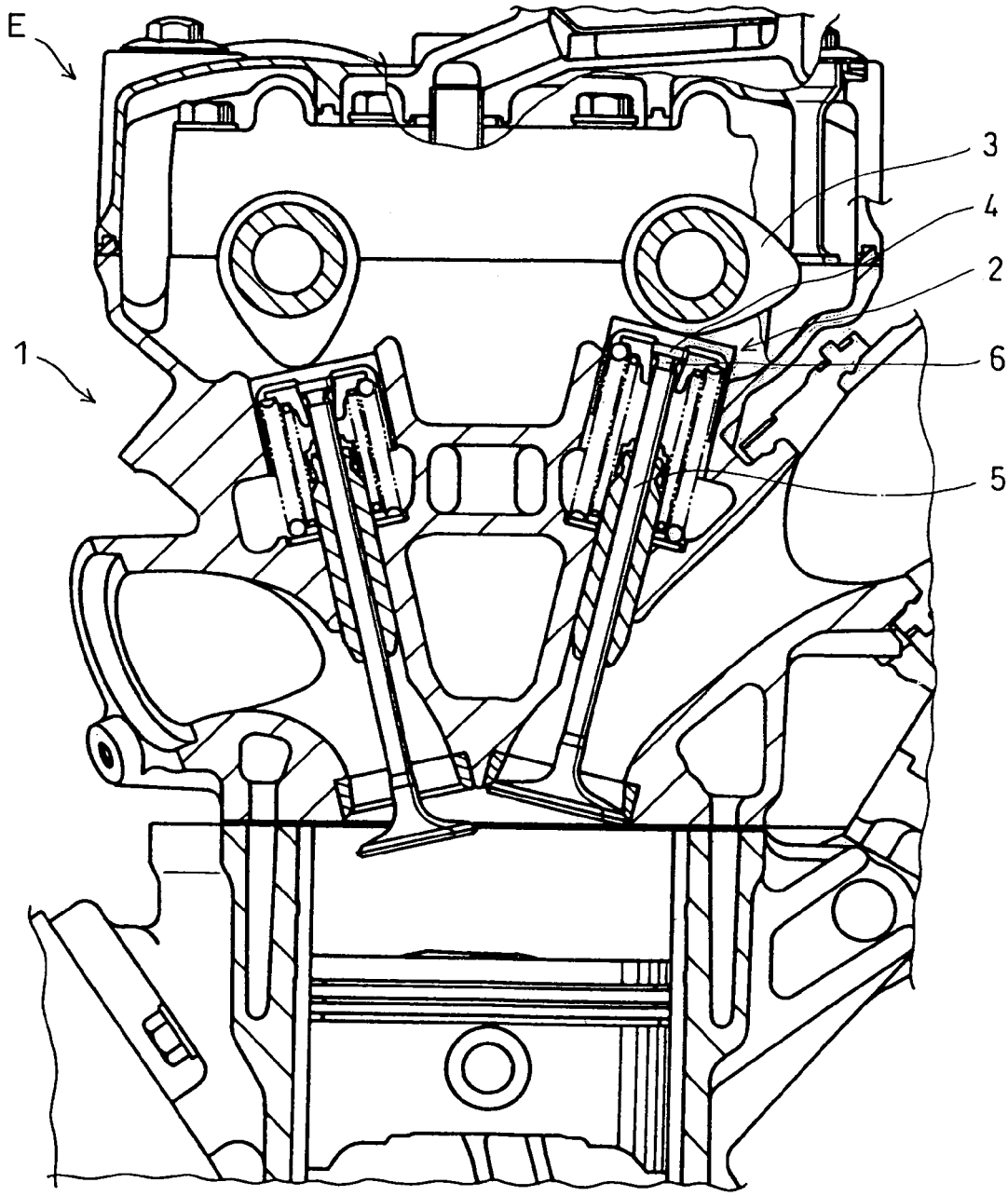
FIG. 1 is a longitudinal sectional view showing a main structure of an internal combustion engine using a valve lifter of the present invention.

FIG. 1 shows a structure of a cylinder head 1 and its associated parts of a DOHC internal combustion engine E. The DOHC combustion engine E includes a valve operating mechanism using a valve lifter of the present invention. Reference numeral 2 in the figure denotes a valve lifter. The valve lifter 2 slides on a cam 3 to be pressed down and depresses an upper end 6 of a valve stem 5 through an inner shim 4.

A description will be given of some examples of the present invention.

EXAMPLE 1

Figure 2:
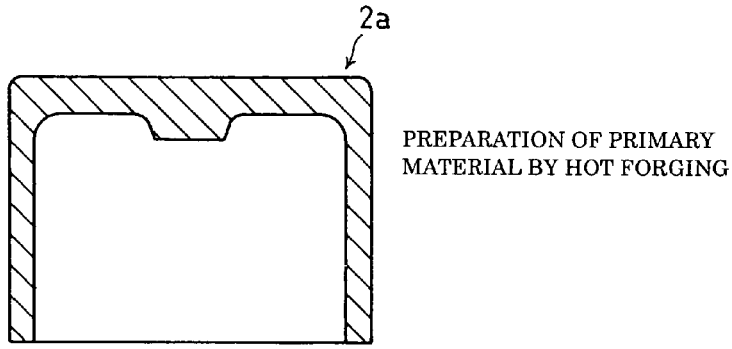
FIG. 2 is an elevational view, in section, showing a primary material used in a process to produce the valve lifter of the present invention.

Using a titanium alloy composed of 0.96 wt % of iron (Fe), 0.32 wt % of oxygen (O), and the remainder including titanium (Ti) and unavoidable impurities, billets (diameter=28 mm and height=7 mm) were produced by machining. Lubricant was then applied to these billets and the billets were dried sufficiently. These billets were forged by a press with a die set, to obtain primary materials 2*a* for the valve lifter 2. FIG. 2 shows such a primary material 2*a*.

Figure 3:
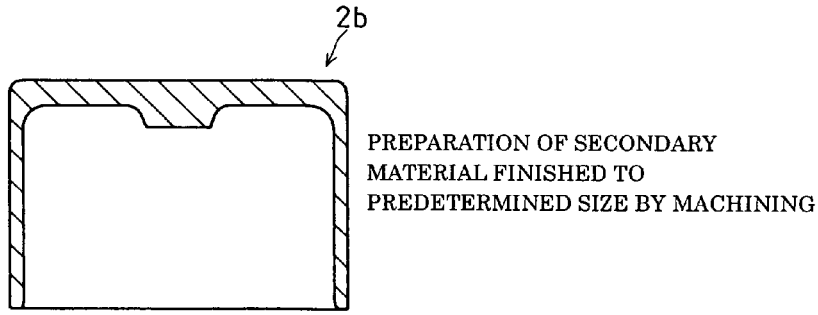
FIG. 3 is an elevational view, in section, showing a secondary material used in the process to produce the valve lifter of the present invention.
Figure 4:
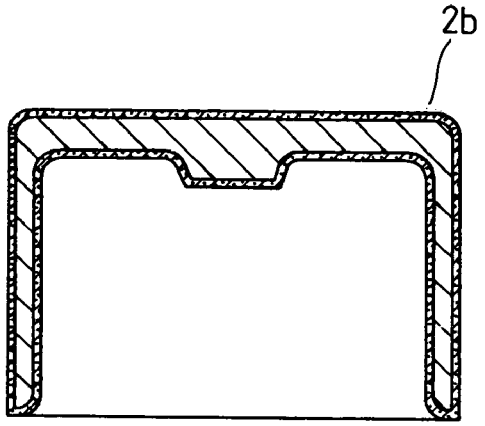
FIG. 4 is an elevational view, in section, showing a state after an oxidation treatment in the process to produce the valve lifter of the present invention.

Parts of each of the primary materials 2*a* were cut by machining and ground to produce a secondary material 2*b* as shown in FIG. 3. At this time, dimensions of the parts were nearly equal to those of a finished valve lifter.

Figure 5:
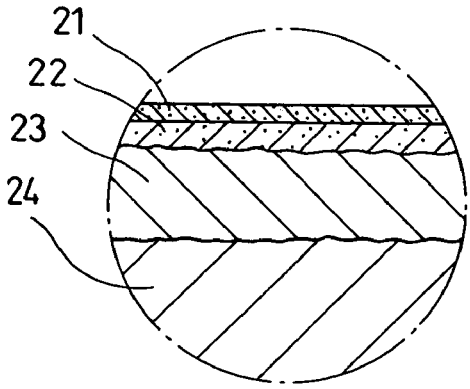
FIG. 5 is an enlarged sectional view showing layers produced as a result of the oxidation treatment in FIG. 4, on the valve lifter of the present invention.
Figure 6:
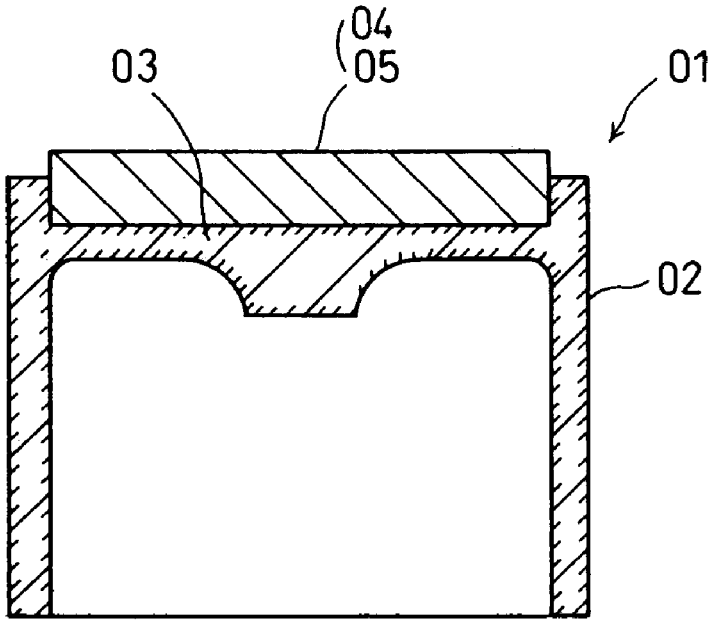
FIG. 6 is a view showing an example of a conventional valve lifter.

After being washed sufficiently, the secondary materials 2*b* were put into a heating furnace at 700° C. and held for seven hours for an oxidation treatment. The atmosphere in the furnace was atmospheric air. As a result, as shown in FIG. 5, (1) an oxide layer 21, (2) an α-case 22, and (3) an oxygen diffusion layer 23 were formed on each of the secondary material 2*b* in this order from the outermost surface thereof. Here, the oxide layer 21 is a part including a large proportion of oxygen and is an oxide, typically $TiO_2$. The α-case 22 is a region of titanium which includes oxygen at high concentration but has not yet formed an oxide. The texture of the α-case region looks white when corroded by etching liquid for titanium. The oxygen diffusion layer 23 is a layer formed under the α-case 22, in which oxygen is diffused into a base material 24. The difference in texture between the base material 24 and the oxygen diffusion layer 23 cannot be confirmed even after etching. However, in measurements of a hardness distribution, by using a micro Vickers hardness meter, in cross section through the oxygen diffusion layer 23 and the base material 24, the hardness gradually becomes lower inwards from the outer surface thereof and becomes equal to the hardness of the base material 24 at a certain depth from the outer surface. The oxygen diffusion layer 23 here indicates a region from the boundary with the α-case 22 to the depth at which the hardness of the cross section is equal to that of the base material 24. In this case, the oxide layer 21 was about 5 μm thick; the α-case 22 was about 7 μm thick, and the oxygen diffusion layer 23 was about 20 μm thick. These thicknesses are determined basically depending on the temperature and time of the oxidation treatment and the composition, but the ratio of the thicknesses of the layers can be adjusted by changing oxygen partial pressure and/or humidity of the atmosphere in the heating furnace.

In conventional cases, after the oxidation treatment, the secondary material 2*b* (treated member) is typically cooled in the heating furnace. However, in the present invention, after a holding time, the treated member was taken out from within the furnace, at a temperature of not less than 400° C. and left in atmospheric air for cooling. This can facilitate removal of the oxide layer 21 in a secondary process, and the removal of the oxide layer 21 can be carried out by a vibration barrel machine which is less harmful to the product. Moreover, forced cooling of the member by a blower or the like also has an excellent effect.

The treated members (secondary materials 2*b*) taken out at a temperature of not less than 400° C. and cooled were put into a barrel of a vibration barrel machine with media of a diameter of 2.5 mm and subjected to grinding for one hour. In the upper surface part and peripheral part of the treated members, the oxide layer 21 was completely removed, and, when a "maximum height roughness" defined in JIS (JAPANESE INDUSTRIAL STANDARDS) B 0601:2001 is conveniently called "surface roughness", a "surface roughness" with a maximum height roughness Rz of 2.3 could be obtained.

For comparison, members which are cooled to a temperature of less than 400° C. and then taken out of the furnace were treated with the vibration barrel machine for 20 hours. In this case, the oxide layer 21 partially remained. The oxide layer 21 was therefore subjected to minute-particle shot blasting to remove the same. However, even if the distance of the members from a shot blasting gun and blasting pressure were adjusted appropriately, part of the α-case 22 where the oxide layer 21 had already been removed was roughed before the oxide layer 21 on the front surface was removed. It was therefore difficult to completely remove the oxide layer 21 without damaging the members.

When the oxide layer 21 remains in the upper surface of the valve lifter 2, which is the sliding surface on which the cam 3 slides, wear of the cam 3 tends to be large during the operation of the internal combustion engine. In addition, when the exposed surface of the α-case 22 is made rough, pitting is likely to occur. Accordingly, it is important to completely remove the oxide layer 21 especially on the sliding surface and to properly control the roughness of the sliding surface.

The thus finished member (valve lifter) 2 was set in a 1000 cc four-cylinder internal combustion engine and then subjected to durability tests. The tests included a test to check the durability at an engine rotational speed higher than an allowable speed limit, a long-term driving test at maximum-power rotational speed, and so on. From this example, it could be confirmed that the valve lifter 2 did not suffer damages, abnormal wear, and the like and had sufficient durability after all durability tests were completed. Moreover, the level of wear of the cam 3 as the associated member was the same or less than that in the case of using a current valve lifter made of steel, which means that the valve lifter processed as above was also good for the associated cam.

EXAMPLE 2

In order to ascertain a proper thickness of the α-case 22, the valve lifters 2 whose α-cases 22 were about 2, 3, 5, 7, 10, 15, and 18 μm thick were produced by adjusting the temperature and time period of the oxidation treatment in a similar process to that of the Example 1, and the valve lifters 2 were subjected to the same durability tests in a similar way. The surface roughnesses thereof were set to uniform maximum height roughness Rz of 3 (JIS B 0601:2001). In the valve lifter 2 whose α-case 22 was 2 μm thick, the oxygen diffusion layer 23 under the α-case 22 was about 7 μm thick. In the valve lifters 2 whose α-case 22 was 3 μm thick or more, the oxygen diffusion layer 23 was 10 μm thick or more. The results of the durability tests show that in the case of the valve lifter 2 whose α-case 22 and oxygen diffusion layer 23 were 2 μm and 7 μm thick, respectively, wear occurred on the sliding surface on which the cam 3 slides during the durability tests. Therefore, the durability tests were discontinued. The other valve lifters 2 were all subjected to the durability tests. Examination made after the durability tests revealed that the valve lifter 2 whose α-case 22 was 18 μm thick had pitting thereon caused by partial separation of the α-case 22. These results have confirmed that good durability is ensured when the valve lifters 2 are so oxidized that the thickness of the α-case 22 is not less than 3 μm and not more than 15 μm and the thickness of the oxygen diffusion layer 23 under the α-case 22 is not less than 10 μm.

Subsequently, durability limits of the valve lifters 2 whose α-cases 22 were 3, 5, 7, 10, and 15 μm thick were evaluated by means of motoring tests. These tests made a comparison of durability in extreme conditions which would actually not occur and were carried out with supply of lubricant oil partially stopped. As a result thereof, slight wear was found in the valve lifter 2 whose α-case 22 was 3 μm thick, and very small pitting occurred in the valve lifter 2 whose α-case 22 was 15 μm thick. It was confirmed that the valve lifters 2 whose α-cases 22 were 5, 7, and 10 μm thick were not damaged at all and were excellent in durability. It was thus confirmed that the valve lifters 2 whose α-cases 22 are not less than 3 μm thick and not more than 15 μm thick have sufficient durability as a valve lifter and furthermore, in extreme conditions, the valve lifters 2 whose α-cases 22 are not less than 5 μm thick and not more than 10 μm thick are excellent. In the valve lifters 2 whose α-cases 22 were 3, 5, 7, 10, and 15 μm thick, the oxygen diffusion layers 23 under the α-cases 22 were not less than 10 μm thick as described above.

EXAMPLE 3

Next, using the valve lifters 2 in which the α-case 22 was about 7 μm thick and the oxygen diffusion layer 23 was about 20 μm thick, effects of the roughness of the sliding surface on which the cam 3 slides were checked with the roughness varied. The valve lifters 2 with maximum height roughnesses Rz of about 2, 3, 4, 5, and 7 were prepared by grinding with the use of the vibration barrel machine to obtain the valve lifters 2 having surface roughness of a maximum height roughness Rz of about 2 and by subsequenly adjusting the roughnesses to the above values by means of minute-particle shot blasting. Each of these valve lifters 2 was set in the aforementioned internal combustion engine for the durability tests. After the tests were finished, the amount of wear of the cam 3 was measured. In the cam 3 which was caused to slide on each of the valve lifters 2 with a maximum height roughness Rz of not more than 4, the amount of wear was equal to or less than that in the cam 3 which was caused to slide on a conventional steel valve lifter. In the cam 3 which was caused to slide on the valve lifter 2 with a maximum height roughness Rz of 5, the amount of wear was 1.5 times that in the cam 3 which was caused to slide on the conventional steel valve lifter. In the cam 3 which was caused to slide on the valve lifter 2 with a maximum height roughness Rz of 7, the amount of wear was about 2.2 times that in the cam 3 which was caused to slide on the conventional steel valve lifter. It has therefore been confirmed that when the maximum height roughness Rz of the valve lifter 2 is 4 or less, the cam on which the valve lifter 2 slides is not subjected to excessive wear.

EXAMPLE 4

In order to find a preferable composition range, materials containing 0.4, 0.6, 0.9, 1.4, 1.7 wt % of iron (Fe) and 0.24, 0.34, and 0.44 wt % of oxygen (O) for each of the above amounts of Fe were prepared, and samples of the valve lifter 2 were produced in a similar process to that of the Example 1. With samples containing 0.4 wt % Fe and 0.24 wt % O, finished valve lifters 2 did not have enough strength and required an increase in wall thickness. This requires changes in the design of the valve and its associated members in an actual internal combustion engine and remarkably reduces the effect of weight reduction, and therefore the intended object cannot be achieved. With samples containing 1.7 wt % Fe and 0.44 wt % O, cracks occurred during forging, and shape forming thereof was difficult. Samples of the valve lifter 2 formed of the remaining materials provided good properties. Thus, it was confirmed that good shape-forming properties can be obtained in case Fe is contained in an amount from 0.6 to 1.4 wt % and that good shape-forming properties without formation of cracks during forging can be obtained in case O is contained in an amount from 0.24 to 0.44 wt % with the above amount of Fe from 0.6 to 1.4 wt %.

The valve lifter 2 of the present invention can be manufactured at a cost drastically reduced by 50 to 70% compared to the conventional titanium valve lifter and can be supplied at such a cost as to allow application to mass-produced vehicles.

The valve lifter 2 of the present invention can be reduced in weight by 40% compared to the conventional steel valve lifters, thus enabling an increase of the rotational speed limit of an internal combustion engine by about 1000 rpm.

Note that the present invention is not limited to use on the valve lifter made of titanium alloy but can be applied in general to members sliding on another member.

What is claimed is:

1. A valve lifter made of a titanium alloy having a sliding surface that makes sliding contact with a cam, said valve lifter having been subjected to an oxidation treatment and comprising:

an α-case formed at least on said sliding surface and having a thickness of not less than 3 μm and not more than 15 μm; and an oxygen diffusion layer formed under said α-case and having a thickness of at least 10 μm, said oxygen diffusion layer being disposed between said α-case and a base material of the valve lifter.

2. The valve lifter made of a titanium alloy according to claim 1, wherein the thickness of the α-case on said sliding surface is not less than 5 μm and not more than 10 μm.

3. The valve lifter made of a titanium alloy according to claim 1, wherein, when represented by a maximum height roughness Rz (JIS B 0601:2001), said α-case formed at least on said sliding surface has an exposed outer surface adapted to make direct sliding contact with the cam, wherein the exposed outer surface of the α-case has a surface roughness equal to a maximum height roughness Rz of not exceeding 4.

4. The valve lifter made of a titanium alloy according to claim 1, wherein the valve lifter is composed of a Ti—Fe—O type alloy containing 0.6 to 1.4 wt % of iron (Fe) and 0.24 to 0.44 wt % of oxygen (O) as main components.

5. The valve lifter made of a titanium alloy according to claim 2, wherein, when represented by a maximum height roughness Rz (JIS B 0601:2001), said α-case formed at least on said sliding surface has an exposed outer surface adapted to make direct sliding contact with the cam, wherein the exposed outer surface of the α-case has a surface roughness equal to a maximum height roughness Rz of not exceeding 4.

6. The valve lifter made of a titanium alloy according to claim 2, wherein the valve lifter is composed of a Ti—Fe—O type alloy containing 0.6 to 1.4 wt % of iron (Fe) and 0.24 to 0.44 wt % of oxygen (O) as main components.

7. The valve lifter made of a titanium alloy according to claim 3, wherein the valve lifter is composed of a Ti—Fe—O type alloy containing 0.6 to 1.4 wt % of iron (Fe) and 0.24 to 0.44 wt % of oxygen (O) as main components.

8. The valve lifter made of a titanium alloy according to claim 1, wherein the α-case having an outer surface that is exposed is a region of titanium and oxygen, the oxygen not being present as an oxide.

9. The valve lifter made of a titanium alloy according to claim 1, wherein, when represented by a maximum height roughness Rz (JIS B 0601:2001), said exposed outer surface of said α-case formed at least on said sliding surface has a surface roughness equal to a maximum height roughness Rz of not more than 2.3.

10. A valve lifter made of a titanium alloy having a sliding surface that makes sliding contact with a cam, said valve lifter having been subjected to an oxidation treatment and comprising:

an α-case formed at least on said sliding surface and having a thickness of not less than 3 μm and not more than 15 μm, the α-case having an outer surface that is exposed and which is adapted to make direct sliding contact with the cam; and an oxygen diffusion layer formed under said α-case and having a thickness of at least 10 μm, said oxygen diffusion layer being disposed between said α-case and a base material of the valve lifter.

11. The valve lifter made of a titanium alloy according to claim 10, wherein the thickness of the α-case on said sliding surface is not less than 5 μm and not more than 10 μm.

12. The valve lifter made of a titanium alloy according to claim 10, wherein, when represented by a maximum height roughness Rz (JIS B 0601:2001), said exposed outer surface of said α-case formed at least on said sliding surface has a surface roughness equal to a maximum height roughness Rz of not exceeding 4.

13. The valve lifter made of a titanium alloy according to claim 10, wherein the valve lifter is composed of a Ti—Fe—O type alloy containing 0.6 to 1.4 wt % of iron (Fe) and 0.24 to 0.44 wt % of oxygen (O) as main components.

14. The valve lifter made of a titanium alloy according to claim 11, wherein, when represented by a maximum height roughness Rz (JIS B 0601:2001), said exposed outer surface of said α-case formed at least on said sliding surface has a surface roughness equal to a maximum height roughness Rz of not exceeding 4.

15. The valve lifter made of a titanium alloy according to claim 11, wherein the valve lifter is composed of a Ti—Fe—O type alloy containing 0.6 to 1.4 wt % of iron (Fe) and 0.24 to 0.44 wt % of oxygen (O) as main components.

16. The valve lifter made of a titanium alloy according to claim 12, wherein the valve lifter is composed of a Ti—Fe—O type alloy containing 0.6 to 1.4 wt % of iron (Fe) and 0.24 to 0.44 wt % of oxygen (O) as main components.

17. The valve lifter made of a titanium alloy according to claim 10, wherein the α-case having an outer surface that is exposed is a region of titanium and oxygen, the oxygen not being present as an oxide.

18. A valve lifter made of a titanium alloy having a sliding surface that makes sliding contact with a cam, said valve lifter having been subjected to an oxidation treatment and comprising:

an α-case formed at least on said sliding surface and having a thickness of not less than 3 μm and not more than 15 μm, the α-case having an outer surface that is exposed and which is adapted to make direct sliding contact with the cam; and an oxygen diffusion layer formed under said α-case and having a thickness of at least 10 μm, said oxygen diffusion layer being disposed between said α-case and a base material of the valve lifter, wherein the valve lifter is manufactured by a process comprising the steps of:

performing the oxidation treatment on a valve lifter material in a furnace at a temperature not less than 600° C. with resultant formation of an oxide layer on the valve lifter material;

taking out the thus treated valve lifter material at a temperature not less than 400° C. from within said furnace and cooling the same in the atmospheric air; and subsequently removing said oxide layer formed at least on the sliding surface of the valve lifter material, for sliding contact with the cam.

19. The valve lifter made of a titanium alloy according to claim 18, wherein said step of removing the oxide layer is carried out by a vibration barrel machine.

20. The valve lifter made of a titanium alloy according to claim 18, wherein, when represented by a maximum height roughness Rz (JIS B 0601:2001), said α-case formed at least on said sliding surface has an exposed outer surface adapted to make direct sliding contact with the cam, wherein the exposed outer surface of the α-case has a surface roughness equal to a maximum height roughness Rz of not exceeding 4.

* * * * *